US006007402A

United States Patent [19]

Nelson, II

[11] Patent Number: 6,007,402

[45] Date of Patent: Dec. 28, 1999

[54] WATER-POWERED WHEELED TOY WITH CONSTRAINED CIRCULAR MOTION

[76] Inventor: Myron E. Nelson, II, 2003 E. Minton St., Mesa, Wis. 85213

[21] Appl. No.: 09/286,106

[22] Filed: Apr. 2, 1999

Related U.S. Application Data

[60] Provisional application No. 60/080,788, Apr. 6, 1998.

[51] Int. Cl.[6] ..... A63H 29/10

[52] U.S. Cl. ..... 446/176; 446/153; 446/159

[58] Field of Search ..... 446/153, 159, 446/176, 180, 217, 218

[56] References Cited

U.S. PATENT DOCUMENTS

| | | | |
|---|---|---|---|
| 729,650 | 6/1903 | Olofsson . | |
| 1,885,620 | 11/1932 | Moyer . | |
| 2,249,211 | 7/1941 | Johnson | 299/49 |
| 2,921,743 | 1/1960 | Westover et al. | 239/188 |
| 3,774,848 | 11/1973 | Herrick | 239/191 |
| 4,292,755 | 10/1981 | Houn | 446/176 |
| 5,224,652 | 7/1993 | Kessler | 446/217 X |
| 5,263,714 | 11/1993 | Rudell et al. | 446/176 X |
| 5,295,890 | 3/1994 | Myers | 446/176 |
| 5,395,274 | 3/1995 | Myers | 446/176 X |
| 5,499,940 | 3/1996 | Johnson et al. | 446/180 |

*Primary Examiner*—Sam Rimell
*Attorney, Agent, or Firm*—Quarles & Brady

[57] ABSTRACT

The invention is a water powered wheeled toy which is constrained to travel in circular orbits. A coupling at the top of a stationary pylon connects a water hose to a swivel coupling. A hose is connected from the swivel coupling to a balance point on a wheeled vehicle. Water is delivered from the hose to the wheeled vehicle where it is delivered to a turbine wheel which drives the wheeled vehicle. The vehicle thus travels in a constrained circular orbit.

1 Claim, 1 Drawing Sheet

WATER-POWERED WHEELED TOY WITH CONSTRAINED CIRCULAR MOTION

CROSS REFERENCE TO RELATED APPLICATIONS

This application is based on provisional application Ser. No. 60/080,788 filed Apr. 6, 1998 and entitled "Water-Powered Wheeled Toy with Constrained Circular Motion" and claims the benefit thereof.

BACKGROUND OF THE INVENTION

The present invention relates to toy vehicles and in particular to a water powered toy vehicle.

DETAILED DESCRIPTION OF THE INVENTION

Figure 1:
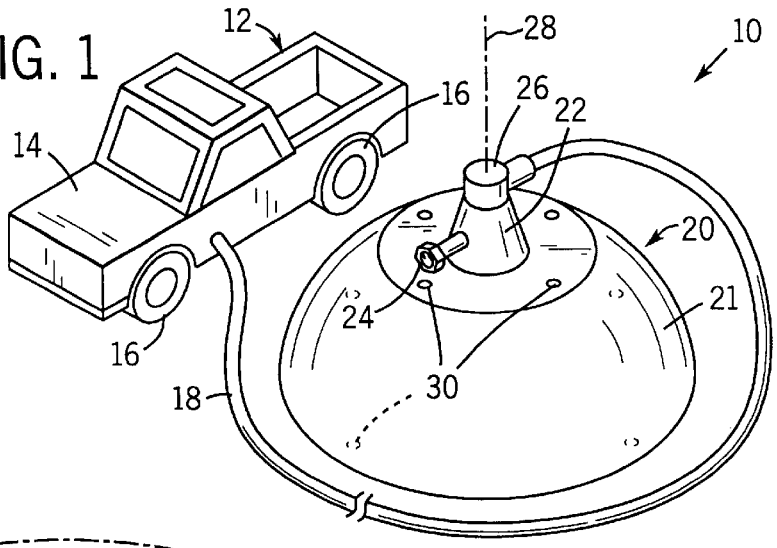
FIG. 1 is a perspective view of the toy vehicle system of the present invention having a vehicle connected by a flexible hose to a center stationary pylon.

Referring to FIG. 1, the toy 10 of the present invention includes a vehicle 12, represented in this example as a toy pickup truck, having a body 14 supporting two pairs of wheels 16 in standard automotive configuration.

Extending from the body 14, near what would be the driver side door on an actual truck, is a flexible hose 18. The hose 18 passes through the body to an internal mechanism that will be described below to extend perpendicularly to the normal direction of travel of the vehicle 12. In the preferred embodiment, the flexible hose 18 is ⅜ inch internal diameter vinyl tubing or other similar material approximately 8 feet in length.

The remaining end of the hose connects to a central pylon 20 being in the form of an inverted bowl 21 having affixed to its topmost surface a rotatable coupling 22. The bowl 21 may include one or more vent holes 30 to reduce water accumulation and heat buildup when the pylon 20 is left on the lawn. The rotatable coupling has a hose coupling 24 that will receive the threaded end of a standard residential garden hose 27 (shown in FIG. 2) to communicate water therefrom to a turret 26, the latter rotatable about a vertical axis 28 passing through the center of the pylon 20. Generally, turret 26 is held loosely captive on a flanged end of a pipe thereby connecting an internal volume of turret 26 water passing through the hose coupling 24. The turret 26 has a radially extending coupling receiving the hose 18 so that the latter may move freely within a generally horizontal plane perpendicular to the vertical axis 28.

Figure 2:
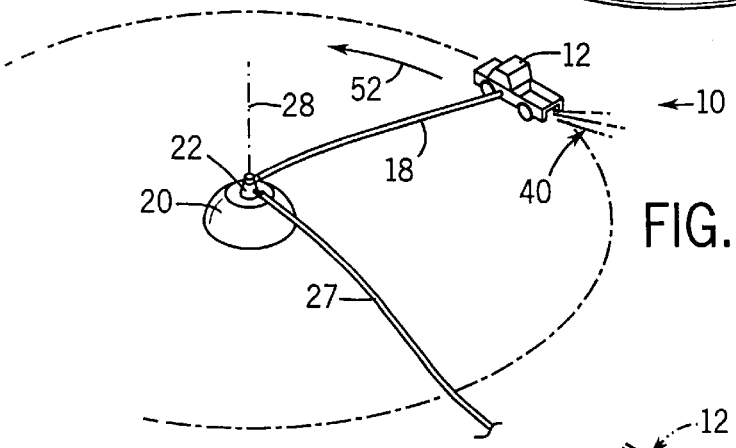
FIG. 2 is a reduced perspective view of the toy vehicle and pylon of FIG. 1 during use with the vehicle following a circle about the pylon.

Referring now to FIG. 2, the garden hose 27 may be connected to the rotatable coupling 22 to supply water under pressure through hose coupling 24 to turret 26 to hose 18 and finally to vehicle 12.

Figure 3:
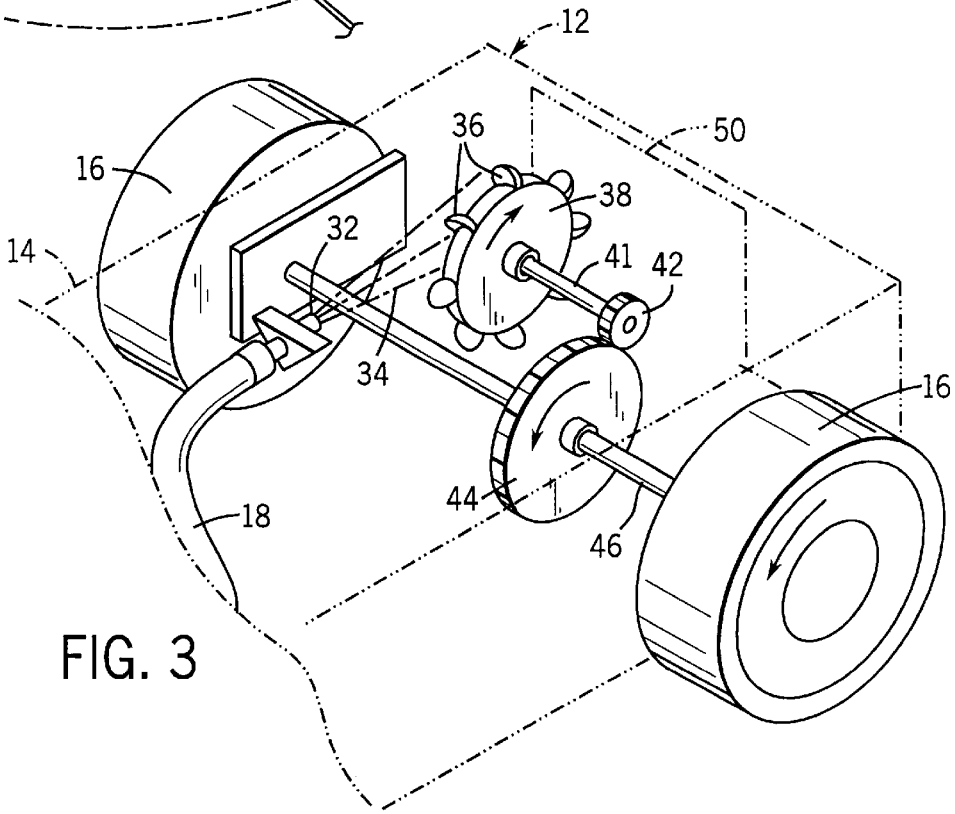
FIG. 3 is a fragmentary perspective view of two wheels of the vehicle with the body of the vehicle shown in phantom revealing a water-powered drive mechanism connected to the two wheels.

Referring now to FIG. 3, the hose 18 passing through the body 14 of the vehicle 12 is attached to a nozzle 32 affixed to the underside of the body 14 and directed rearward in front of the rear wheels 16. The nozzle 32 directs a stream of water 34 to strike one or more cup elements 36 extending radially around the upper circumference of a turbine wheel 38, the latter positioned behind the nozzle 32 to rotate in a vertical plane. In an alternative embodiment (not shown), the turbine can be enclosed to help funnel or direct discharged water. The discharged water may be directed as a "jet" exhaust from the rear of the vehicle, or through a turreted "gun" or "water hose" for a toy fire engine vehicle. In this embodiment, nozzle 32 and cup elements 36 and turbine wheel 38 are enclosed to provide containment of water flow to provide more power from stream of water 34 and to provide additional water discharge for accessories or for fan tail 40 from the rear of the vehicle. The turbine wheel 38 is in turn connected via a drive shaft 41 to a spur gear 42 engaging a reduction gear 44 of substantially greater diameter to produce a gearing down of approximately 10 to 1. The reduction gear 44, in turn, attaches to an axle 46 which supports the rear wheels 16 of the vehicle 12. As will be understood from the foregoing description, the impact of the water stream 34 on the upper side of the turbine wheel 38 causes a clockwise rotation of the turbine wheel 38 imparting a counterclockwise rotation to the reduction gear 44 and, via the axle 46, to the wheels 16 causing the vehicle 12 to move forward.

Referring to FIGS. 2 and 3, after water from the nozzle 32 strikes the turbine wheel 38, the water flies out in a fan tail 40 from the rear of the vehicle 12 through a cutout 50 shown in FIG. 3 or through any other area of the vehicle or added accessories.

The torque provided to the wheels 16 causes the vehicle 12 to attempt to proceed tangentially to the hose 18. The present inventors have determined that by attachment of the hose 18 to the vehicle 12 at the proper orientation and position along the side of the vehicle 12, that the hose 18 will provide an inward restraining force to the vehicle 12 causing the vehicle to move in a circumferential direction 52 without substantial radially inward or outward motion. The positioning of the hose 18 may be determined empirically as a function of vehicle size, hose length, hose stiffness and the like. Thus restrained by the hose 18 and pylon 20, the vehicle travels in a circumferential path 52 about the pylon 20 with the fan tail 40 exiting from the back of the vehicle 12.

The size of the turbine wheel 38 and the reduction of spur gear 42 and reduction gear 44 is selected so that the torque delivered to the rear wheels of the vehicle is sufficient to allow the vehicle to climb over small obstacles such as ramps or the like.

The major components of the toy 10 may be constructed of injected molded plastic with the exception of the axle 46 and drive shaft 41 which are preferably metal onto which injection molded components may be press fit.

It will be understood that many variations are possible including vehicles 12 of different styles such as cars, or with different wheel constructions including those with treads or even representations of fanciful animals or creatures.

I claim:

1. A water powered toy vehicle comprising:

a stationary pylon having a first coupling adapted to receive a water hose, the first coupling communicating water received from the water hose to a swivel coupling extending from the top of the stationary pylon;

a flexible hose connected at one end to the swivel coupling to extend substantially radially therefrom so as to receive water therefrom as the hose orbits the stationary pylon;

a wheeled vehicle receiving the other end of the flexible hose at a balance point in the side of the vehicle; and a turbine gear assembly attached to the wheeled vehicle receiving water from the flexible hose to provide torque to at least one wheel of the vehicle;

whereby the balance point is selected to cause the vehicle to travel freely about the stationary pylon.

* * * * *